US007373849B2

(12) United States Patent
Lloyd et al.

(10) Patent No.: US 7,373,849 B2
(45) Date of Patent: May 20, 2008

(54) AUTONOMOUS RECONNAISSANCE SONDE, AND METHOD FOR DEPLOYMENT THEREOF

(75) Inventors: Peter Gregory Lloyd, Salisbury (GB); Paul Jonathan Stein, Eastleigh (GB)

(73) Assignee: Roke Manor Research Ltd., Romsey (GB)

( * ) Notice: Subject to any disclaimer, the term of this patent is extended or adjusted under 35 U.S.C. 154(b) by 364 days.

(21) Appl. No.: 11/178,440

(22) Filed: Jul. 12, 2005

(65) Prior Publication Data

US 2006/0010998 A1 Jan. 19, 2006

(30) Foreign Application Priority Data

Jul. 16, 2004 (GB) ..... 0416204.6

(51) Int. Cl.
*G01M 19/00* (2006.01)

(52) U.S. Cl. ..... 73/865.8

(58) Field of Classification Search ..... 73/865.8
See application file for complete search history.

(56) References Cited

U.S. PATENT DOCUMENTS

| | | | | |
|---|---|---|---|---|
| 3,704,764 | A * | 12/1972 | Henderson | 181/141 |
| 3,721,410 | A * | 3/1973 | Anspacher | 348/144 |
| 4,267,562 | A * | 5/1981 | Raimondi | 348/144 |
| 4,533,945 | A * | 8/1985 | Lauvray et al. | 348/144 |
| 5,032,098 | A | 7/1991 | Balogh et al. | |
| 6,155,155 | A | 12/2000 | Moshier | |
| 6,378,437 | B1 * | 4/2002 | Burke et al. | 102/293 |
| 6,380,889 | B1 | 4/2002 | Herrmann et al. | |
| 6,761,117 | B1 | 7/2004 | Benz | |
| 2002/0196339 | A1 * | 12/2002 | Heafitz | 348/144 |
| 2003/0119613 | A1 | 6/2003 | Samuel et al. | |

FOREIGN PATENT DOCUMENTS

| | | |
|---|---|---|
| DE | 40 00 902 A1 | 7/1991 |
| DE | 41 00 827 A1 | 7/1992 |
| EP | 1 403 610 A1 | 3/2004 |
| FR | 2 518 733 | 12/1981 |

OTHER PUBLICATIONS

European Search Report, dated Nov. 2, 2005 (Three (3) sheet).

* cited by examiner

*Primary Examiner*—Robert Raevis
(74) *Attorney, Agent, or Firm*—Crowell & Moring LLP

(57) ABSTRACT

A method for deploying a reconnaissance sonde, including the steps of: incorporating at least one environmental sensor and an associated communication device into a robust, aerodynamically efficient casing; deploying the sonde by imparting a spin and a directional velocity to the casing, sufficient to carry the sonde into a region of interest; and establishing communication with the communication device, thereby enabling data from the sensor(s) to be transmitted to a remote location. A sonde for remote data collection is also provided, including at least one environmental sensor, an energy source and communication means. The sonde is generally shaped as a discus or saucer, a clay pigeon or skeet, for deployment by applying a spin and directional velocity to the sonde.

15 Claims, 6 Drawing Sheets

AUTONOMOUS RECONNAISSANCE SONDE, AND METHOD FOR DEPLOYMENT THEREOF

The present invention relates to surveillance sensors, and particularly relates to rapidly deployable autonomous sensor carrier ("sonde") for human or other surveillance, a method for deploying such sondes, and a surveillance system employing such sondes.

BACKGROUND AND SUMMARY OF THE INVENTION

In many situations, it is desirable to monitor environmental conditions and/or human or animal activity at a position remote from the observer. This may be because the surveyed region is extensive, so that direct observation of the entire region is impractical. It may be because direct observation would disturb the phenomenon to be observed, for example in the case of observing human or animal behaviour. It may be because the surveyed region is dangerous for direct observation for reasons such as chemical or radiological pollution, seismic or water activity, or the threat of violence from other interested people.

For whatever reason, in these situations, it is required that a sonde may be deployed rapidly and accurately, so that personnel employed in the deployment of the sondes spend as little time as possible in the surveyed location. It is further required that the sonde be autonomous, sensitive to the events of interest and robust enough to require no maintenance after deployment, and have a useful lifetime.

U.S. Pat. No. 6,380,889 describes a reconnaissance sonde carrying sensors and communication equipment. The described sonde is deployed from a rocket, which breaks up to reveal a sonde on a parachute, which descends into the surveyed region. German patent applications DE 4104800 and DE 3313648 and U.S. Pat. No. 3,962,537 all describe surveillance sensors and communication devices, which are launched from a gun, or deployed from a missile.

While such deployment methods may be suitable for the battlefield, they are unsuitable for the purposes of the present invention. The deployment methods described are very long-range. Typically, the sensor will be deployed several kilometers from the launch site. This means that the position of deployment can only approximately be determined before launch. The launch and arrival of the sensor will be very prominent events: the launch being accompanied by the sight and sound of a gun firing or a missile or rocket launching. The arrival of the sensor will be accompanied by the sight of an incoming artillery shell, missile or rocket, breaking up to deploy a parachute carrying the sensor to ground. Such methods are accordingly most unsuitable for situations in which the deployment of sensors is desired to pass relatively unnoticed. Such situations include the monitoring of animal behaviour, or the monitoring of human activity.

The present invention aims to provide a sonde and a method for deploying a sonde, suitable for rapid and accurate short-range ground placement of the sondes. The sonde and the method are suitable for applications such as detection and monitoring of human or animal activity, detection of ground or airborne vehicles, and environmental monitoring. The deployment method and the sonde itself should not be intimidating, to avoid the sonde and the deployment from influencing any activity which is to be monitored. Examples of situations in which human activity may be required to be detected or monitored include crowd control at sports events, political rallies and demonstrations, in disaster relief to detect the presence of survivors, or in monitoring hostile situations.

GB 2386673 describes a target immobilisation device or bolas, which is launched by imparting a spin and a directional velocity to the device or bolas, sufficient to carry it to a target. The device or bolas may carry a radio receiver and loudspeaker. The device or bolas may carry a proximity sensor, imaging sensor or radar device. Images may be formed at a remote location.

FR 2518733 describes a fixed lookout post with vertically ejectable observation platform carrying an infra red detection.

U.S. Pat. No. 6,155,155 discloses a disk shaped anti-mine munition and launcher.

U.S. Pat. No. 6,761,117 discloses a combined reconnaissance sonde and ordinance system in the form of a hand grenade.

GB 1 213 389 discloses a system for launching disk shaped projectiles in a pattern surrounding the launcher.

BRIEF DESCRIPTION OF THE DRAWINGS

The above, and further, objects, characteristics and advantages of the present invention will become more apparent by reference to the following description of certain embodiments, given by way of examples only, together with the accompanying drawings, wherein.

DETAILED DESCRIPTION OF THE INVENTION

Figure 1:
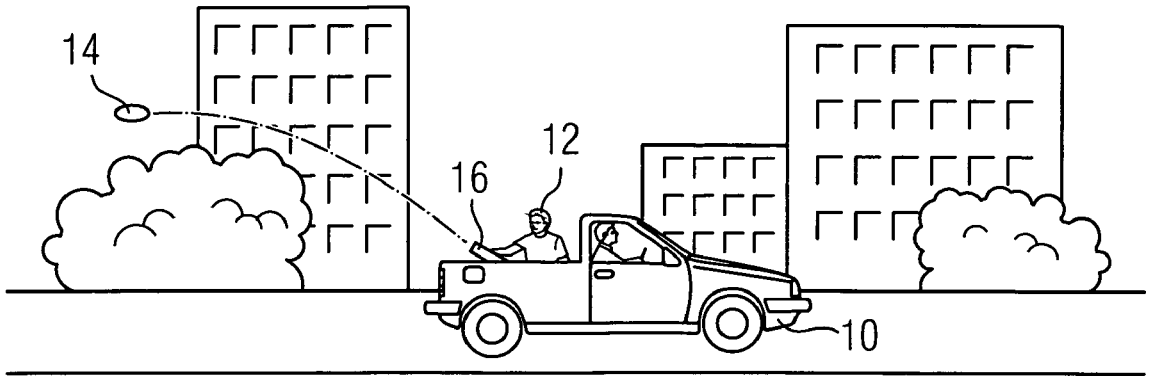
FIG. 1 is a perspective view that illustrates a method according to the present invention for deploying sondes.

FIG. 1 illustrates an arrangement according to an aspect of the present invention wherein a vehicle 10 (in this case a manned vehicle but the invention may also be applied to unmanned vehicles) is driven through or alongside a region of interest. In FIG. 1, by way of example, the region of interest is an urban or suburban region. An operator 12 is employed in deploying surveillance sondes, such sondes being provided according to another aspect of the present invention. The sondes 14 are projected by a launcher 16 into the region of interest. In an embodiment of the invention, the launcher 16 is capable of launching the sondes a distance of up to about 100 meters. Typically, however, the sondes would be launched a distance of up to about 10 meters from the launcher.

In another embodiment of the invention, the sondes may be thrown by hand, from a vehicle or by a pedestrian. In another embodiment of the invention, an automatic or remote controlled launcher may be provided, carried by a manned or unmanned vehicle, to project the sondes into the region of interest.

Figure 2:
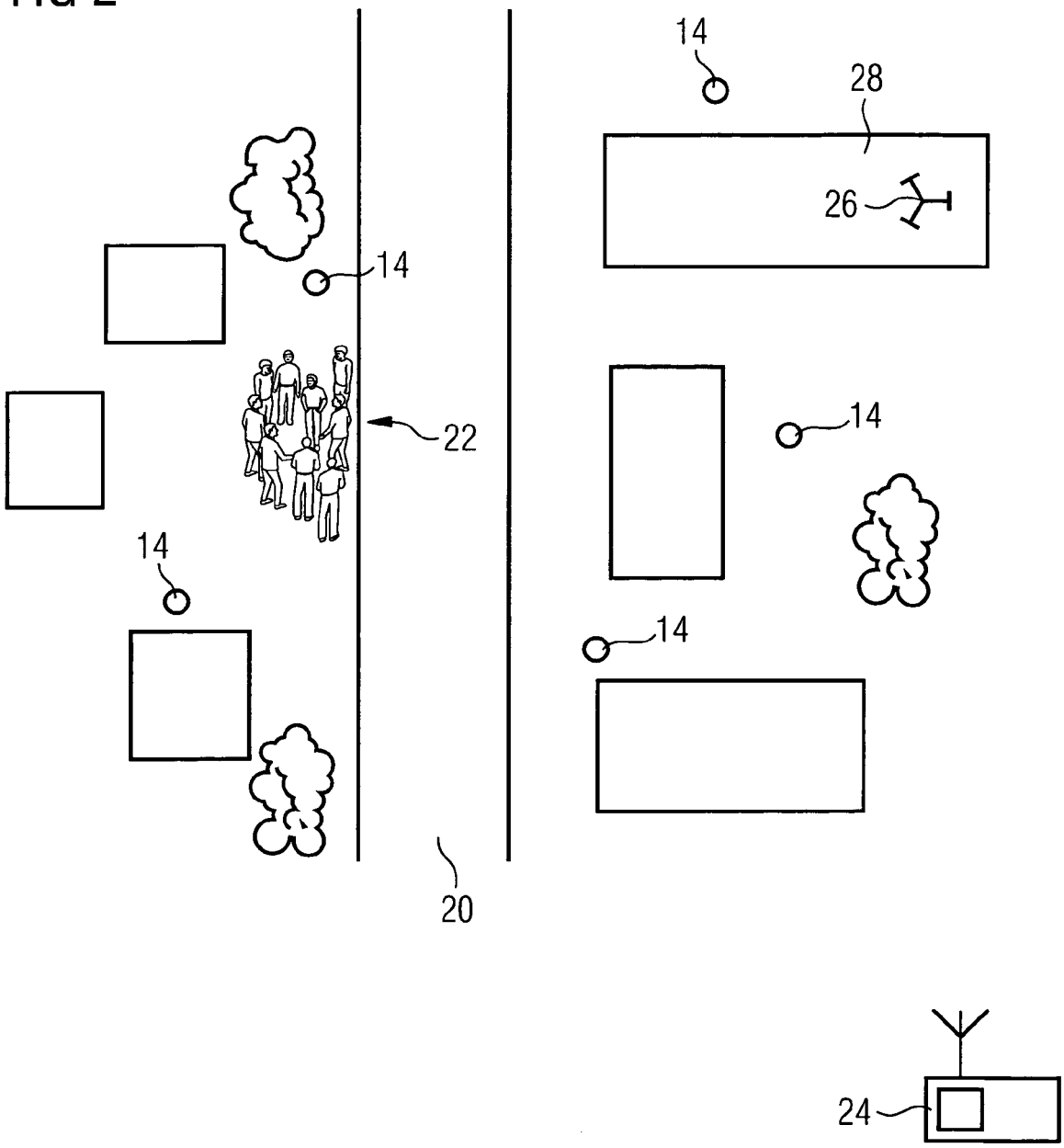
FIG. 2 is a schematic illustration of an environment containing sondes deployed according to the present invention.

FIG. 2 represents a plan view of the urban environment shown in FIG. 1, after the passage of vehicle 10. The vehicle 10 has passed along the road 20 and in passing has deployed sondes 14 at various locations within the illustrated region of interest. As the launcher 16 is capable of projecting sondes 14 a distance of up to about 100 meters, the sondes may be deployed in various locations, at varying distances from the roads. With suitable choice and arrangement of the launcher, it may be possible to project the sonde over a low building. A gathering of people 22 is collecting in the region of interest. Their presence and activity will be detected by various types of sensor included within the sonde 14.

As will be discussed in more detail below, the sondes may be equipped with sensors such as microphones, video cameras and so on. The sondes may be provided with presence or movement detectors such as radar or CELLDAR™. CELLDAR™ is a presence or movement sensor system, which emits no signals, but detects reflections of signals such as mobile telephone signals from antennas 26. It is described in more detail in International patent application WO 03/012473. In an urban environment, it is useful for detecting the presence and velocity of vehicles.

The sondes are preferably also equipped with a location determining means, such as a GPS receiver or the like. The sondes are equipped with means for telecommunication, such as a radio transmitter. The transmitters may transmit information, typically including GPS position and data provided by the sensors to a central receiving location 24. This may, for example, be a police station. The sondes may be arranged to communicate according to WLAN and/or GPRS radio communications standards. Alternatively, the sondes may be provided with transmitters suitable for communication over a mobile telephone network. This latter option is particularly suitable for urban deployment, where coverage by mobile telephone antennas 26, for example atop buildings 28, is good, but direct transmission to receiving station 24 may be blocked by the presence of such buildings. Once communicated to the mobile telephone network, the data may of course be carried anywhere in the world by the standard telephone network. Other means of wireless communication, such as WAP Internet access, may be provided to allow the sondes to transmit their data.

The sondes 14 may also be equipped to communicate amongst themselves, for example to provide relay stations to convey data from distant sondes to the central receiving location 24, or to confer among peers to detect the direction of travel of any detected activity. Such calculations may alternatively be performed at the central receiving station 24 or other remote location.

The embodiment described above relates to monitoring the activity of a group of people in an urban environment. Such applications could relate to monitoring the activities of demonstrators, football crowds and so on. Other applications of the present invention include detecting the presence and/or movement of vehicles in a certain areas, for example for security purposes; the monitoring of the presence and activity of animals, environmental monitoring, pollution control, monitoring of seismic activity, monitoring human activity in situations such as a siege or hostage holding, where it is desirable to monitor activity and possibly also provide a communication link without physically approaching the area of interest. In all of these applications, it is advantageous that the method of deployment should be as rapid as possible, so that the deploying personnel and/or equipment spend as little time as possible in or adjacent to the region of interest. It is also advantageous that the deployment of sensors and the sensors themselves, are unobstrusive and non-threatening to the persons, animals etc. under surveillance. Deployment and/or sondes which are not unobstrusive, or which are threatening, are to be avoided since they would likely modify the behaviour which is to be observed, and/or may provoke an aggressive response from the persons, animals etc. under surveillance.

Preferably, the sonde is of a suitably inconspicuous colour; a concrete grey, grass green, sandy brown or mud brown colour, for example. The object of such camouflage is firstly to reduce the likelihood of persons or animals under surveillance from noticing the presence of the sonde, and secondly to make the sonde appear unattractive to such persons or animals if the sonde is noticed. Sondes may be produced in different colours, and/or with differing combinations of sensors for deployment in different environments.

Figure 3:
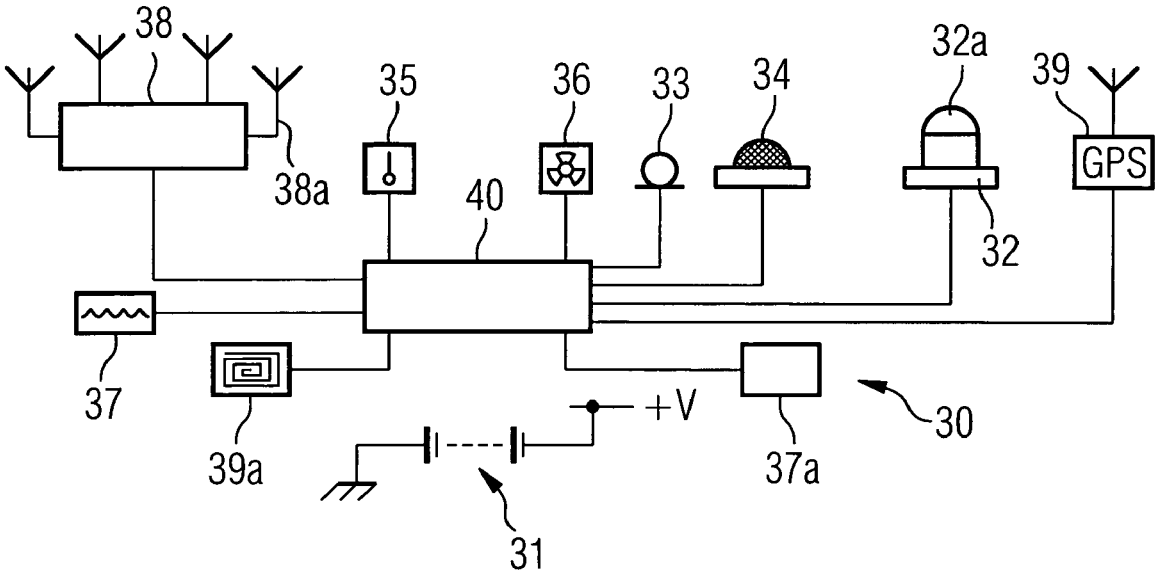
FIG. 3 is a block diagram of circuitry contained within a sonde according to the present invention.

FIG. 3 shows a block diagram of circuitry 30, conventional in itself, which may be incorporated into a sonde according to an embodiment of the present invention. A source 31 of electrical energy provides power for the circuitry. Source 31 may be a conventional battery, a charged capacitor, a solar cell or any other appropriate means for providing electrical energy. In one embodiment of the invention, source 31 comprises one or more low profile rechargeable batteries, such as NiMH, Lithium polymer or Li-ion batteries such as are currently employed in mobile telephones. Optionally, a battery charger may be built in to the sonde. Preferably, this would comprises an induction coil within the sonde, arranged to receive magnetic fields from an external device, and convert the magnetic energy into electrical energy for charging the battery. Such circuits and coils are conventional in themselves.

A number of sensors are provided in the sonde. As shown in FIG. 3, these sensors may include at least one of the following: a video camera 32, a microphone 33, a gas and/or biological species detector 34; a seismometer 35; a radiation detector 36; a humidity sensor 37; an air pressure sensor 37*a*. The video camera is preferably provided with a fisheye lens 32*a* or other arrangement allowing all-round viewing. The video camera should be as small and light as possible. It is presently envisaged that a miniature CCD (charge-coupled device) camera, similar to those currently included in some mobile telephones, would be used.

According to an embodiment of the invention, the sondes may be provided with a presence and/or motion sensor, for example, antennas and circuitry able to operate to measure the presence and/or speed of an approaching or receding ground or airborne vehicle. Such systems include radar and CELLDAR™ as described above. Any radar, CELLDAR™ 38 or similar device must be provided with a number of antennas 38*a*. This option will be discussed in more detail below.

The sonde may also be equipped with a radio detector or receiver, for detecting the presence of radio signals emitted by other systems, such as radar or communications systems. The radio detector or receiver may be arranged to detect the content and direction and/or distance of the source of the radio signals. A number of antennas, such as antennas 38*a* may be required to enable the operation of such a radio detector or receiver.

Any other type of sensor may be included within the sonde, together with appropriate control circuitry. It is envisaged that only a subset of the possible sensors would be included in any one sonde. The combination of sensors provided in a particular sonde should be chosen according to the required functions of the sonde, which in turn depends on the activity to be monitored using the sonde and the environment in which it is to be placed. The various sensors which may be employed will hereafter be referred to as environmental sensors, where "environmental" takes its broadest meaning, relating to any aspect of the environment in which the sonde is located.

The sonde will typically include a GPS receiver 39 or the like, enabling the sonde to determine its location.

A communication antenna 39*a*, for example a planar patch antenna, is provided to enable the communications and control circuitry 40 to transmit, and optionally also to receive, data to/from the central receiving location 24 and/or peer sondes 14.

All of the above-mentioned sensors are conventional in construction and operation. They are connected to control and communication circuitry 40, conventional in itself, to interpret the sensors' readings and to transmit the corresponding data to the central receiving location 24. The present invention does not relate to the sensors themselves, nor to the control and communication circuitry itself.

Figure 4:
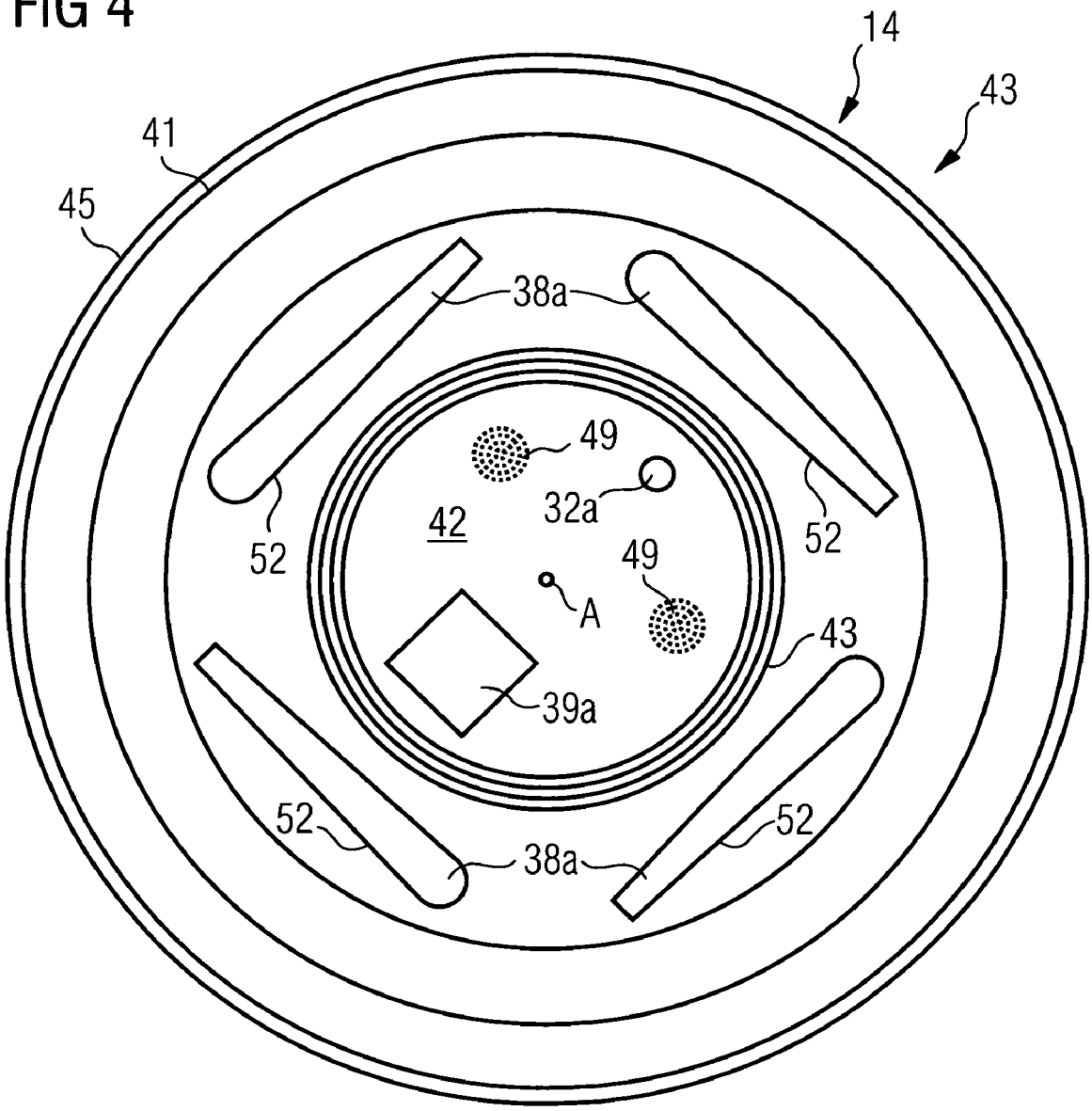
FIGS. 4-5 are plan and cross-sectional views, respectively, of a sonde according to the present invention.
Figure 5:
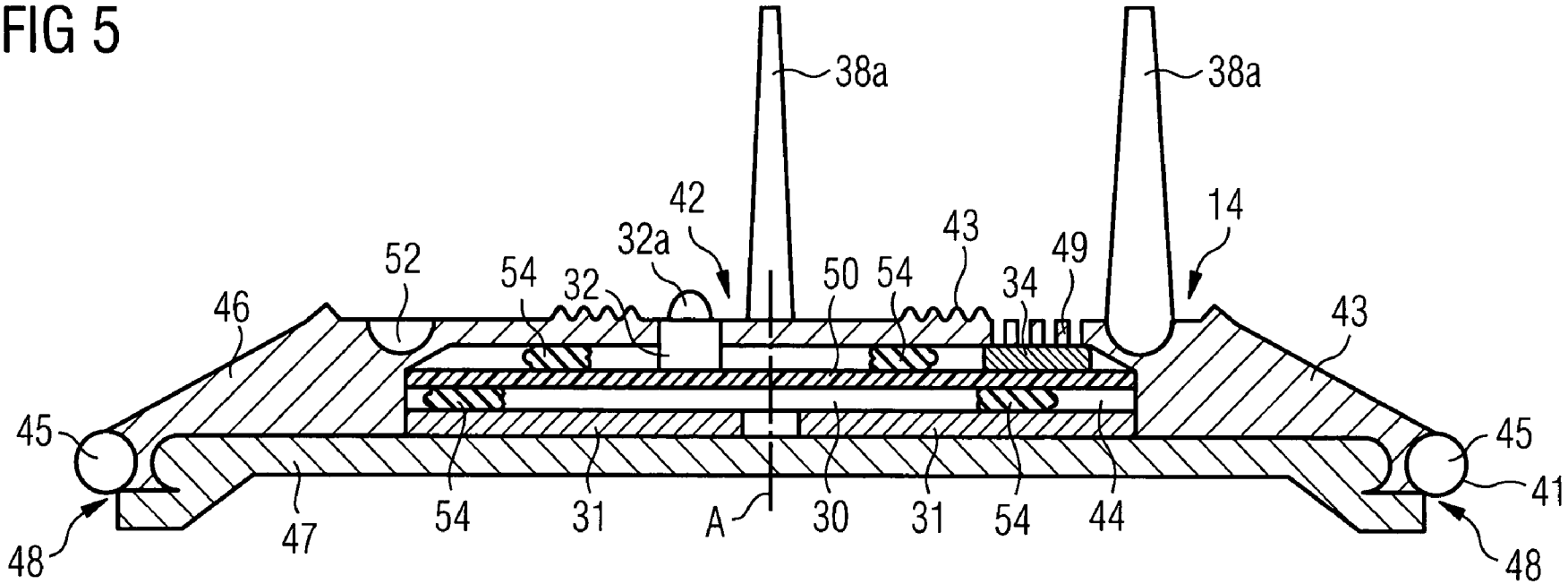

The sonde according to an aspect of the invention, and as illustrated in FIGS. 4-5, is generally discus or saucer shaped. The shape could alternatively be compared to a clay pigeon or skeet. The sonde is shaped for good aerodynamic performance ensuring a long and predictable flight when launched from a launcher, or by hand.

FIGS. 4 and 5 respectively show plan and cross-sectional views of a sonde according to an embodiment of the present invention. The sonde comprises an aerodynamically shaped casing 43, preferably in the general form of a saucer or a discus. The shape may also resemble a clay pigeon or skeet. The underside is hollowed to provide aerodynamic lift. The sonde has an outer rim 41 and an inner region 42. Ridges 43 and other aspects of the shape of the sonde may be provided to assist the aerodynamic performance of the sonde. An outer ring 45 is preferably provided. This ring may be of a material such as neoprene.

The sensors provided within the sonde will need to communicate with the external environment. The fisheye lens 32*a* (or other optical receiving means) protrudes through and above the upper part 46 of the casing. A pattern of holes 49 may be provided to provide a path from the atmosphere to any of: gas or biological sensor 34; microphone 33; humidity sensor 37; air pressure sensor 37*a* or other sensors requiring access to the atmosphere, as appropriate. It may be unnecessary to provide such holes for microphone 33, if it is sufficiently sensitive. Care should be taken to ensure that the sonde as a whole is at least sufficiently watertight to resist significant water ingress. If a planar patch antenna 39*a* is employed, a flat region of the casing may need to be provided above the patch antenna to provide a region of constant dielectric thickness above the antenna. This flat region may conveniently be employed for affixing an information or warning label. In an embodiment of the invention, the casing 43 has a diameter of approximately 15 cm and a thickness of approximately 3 cm.

Some sensors such as radar or CELLDAR™ presence and motion detectors may require the deployment of antennas 38*a* of a required length and/or orientation which renders their incorporation within the casing 43 impractical. In such instances, retractable antennas may be provided. In FIG. 5, the antennas 38*a* are shown in their deployed, operational position. For reasons of aerodynamics, storage and durability, it is preferred not to launch the sonde with the antennas in this deployed state. As also illustrated in FIG. 5, recesses 52 may be provided in the upper part 46. The antennas 38*a* may be folded down into corresponding recesses 52 and latched into a stowed position. This provides the sondes with a more aerodynamic shape, which requires less storage space. The antennas remain in the stowed position during storage and during launch. Preferably, when the sonde reaches the end of its flight and hits the ground, the attendant shock causes the latches restraining the antennas 38*a* to release the antennas. The antennas are preferably spring-loaded, and so rise into the deployed position, illustrated in FIG. 4, once the latches are released. Of course, some embodiments of the present invention will not require such antennas. Further development of the invention may provide antennas which may be incorporated within the casing 43 without the need for the above-described deployment method. Other methods and arrangements for retractable antennas may be provided.

A rugged casing 43 encloses a cavity 44, which contains circuitry 30 such as shown in FIG. 3. The circuitry is preferably assembled onto one or more circuit boards 50. The circuit boards 50 should be provided with shock absorbing means to reduce the risk of damage to the circuit boards during deployment of the sonde. An example of suitable shock absorbing means is a pair of elastomer rings. In the illustrated embodiment, an upper part 46 and a lower part 47 of the casing 43 are separately formed, for example by injection moulding. The outer periphery 48 of each of these parts may be formed such that they interlock, retaining the casing as a single piece. The outer ring 45 may be stretched into place, and may serve to assist in holding the parts 46, 47 of the casing together. In other embodiments, the two parts 46, 47 may screw together, be held by screws, rivets or snap fittings. In some embodiments, the circuitry 30 may be moulded into the material of the casing 43, in which case cavity 44 is only a notional expression indicating the location of placement of the circuitry 30.

Figure 5A:
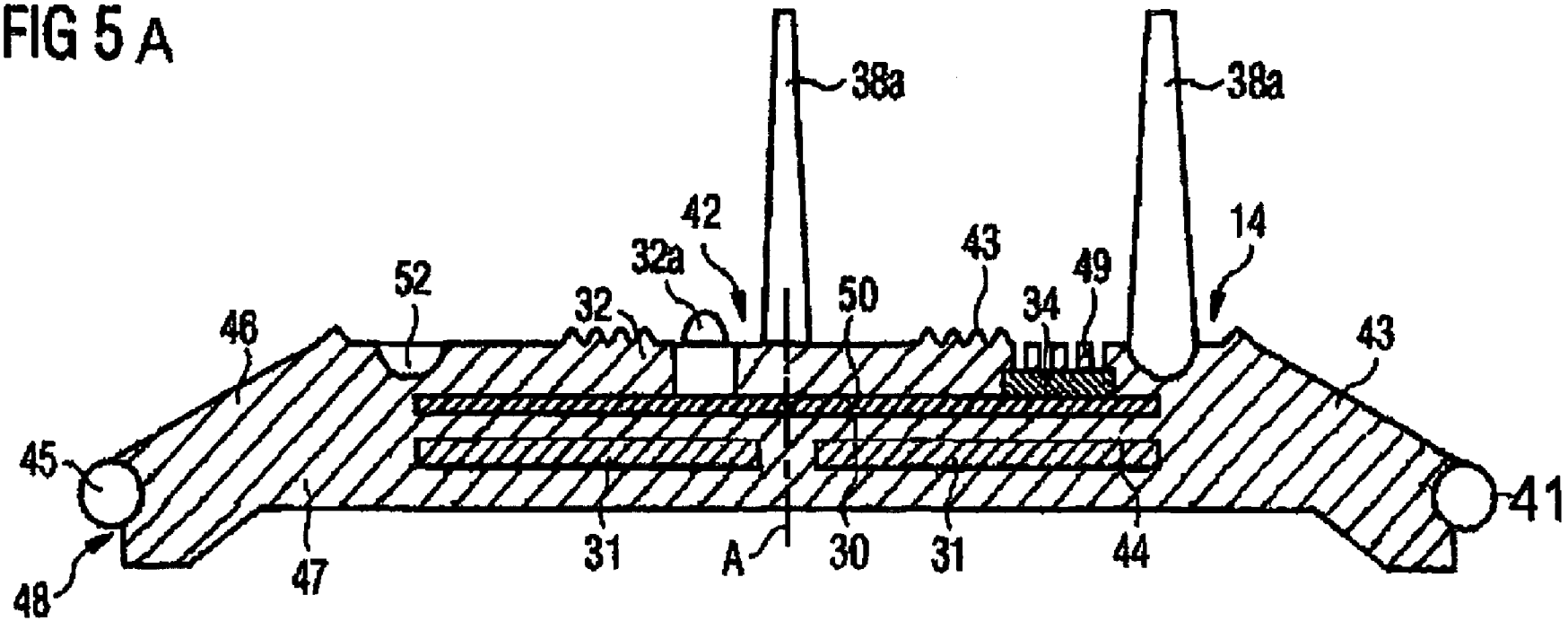
FIG. 5A shows another embodiment of the sonde according to the invention, in which the body is moulded as a single piece.

The material chosen for any ring 45 should be resilient, with a relatively high coefficient of friction. The material chosen for the remainder of the casing 43 should also be resilient, not brittle. The casing, at least in the region of the rim 41, should be of resilient material, such as synthetic rubber, polyethylene, PVC or similar materials. It should maintain its shape under impact forces, and be strong enough to withstand a certain degree of abuse. A material used for casing 43 in an embodiment of the invention was NORYL®, a modified polyphenylene oxide resin which may be glass-filled for added strength. Other materials may be found suitable, such as polyethylene, PVC, synthetic rubber compounds. The casing 43 may be produced by injection moulding in two parts. Alternatively, the circuitry and sensors shown within the cavity 44 in FIG. 5 may in fact be embedded within a solid single piece injection-moulded casing, as shown in FIG. 5A.

The sonde 14 in launched as described above, and will typically hit the ground rim-first. It is therefore preferable that the material of the rim should absorb a significant amount of the shock of the impact by deforming, at least temporarily. The material of the casing 43 should, however, not be so flexible that damage to the circuit 30 could occur due to flexing of the whole sonde. Rim 41 and any ring 45 may be designed to encourage the sonde to roll on its edge along the ground away from its point of impact. The shape of the casing 43 and the distribution of weight within the sonde should be arranged such that the mode will tend to come to rest the right way up, that is, in the orientation shown in FIG. 5.

Some deployed sondes may come to rest on their edge, in vegetation, behind an obstacle, or in an inverted state. The sondes may be equipped to detect this condition and to transmit an "ERROR" or "HELP" signal to the central receiving location 24. A replacement sonde may be deployed, or manual intervention may be employed to correct the orientation of the sonde. Similarly, the GPS receiver in the sonde may detect motion of the sonde after deployment, typically indicating that the sonde has been stolen or carried away by an animal, or by water, or by other agents. The sonde may transmit a "HELP" signal in this case to the central receiving location, prompting deployment of a replacement sonde and/or recovery of the original sonde.

According to an aspect of the present invention, when the sonde is launched, a spin about axis A (FIGS. 4, 5) is applied to the sonde, along with a directional velocity sufficient to carry the sonde to a selected deployment position within the region of interest. The spin is applied to provide gyro-stabilisation of the sonde in flight. This may be applied by throwing the sonde manually in the manner of a FRISBEE® flying disc, or in the manner of a discus. The spin may alternatively be provided by a mechanical launcher.

Figure 6:
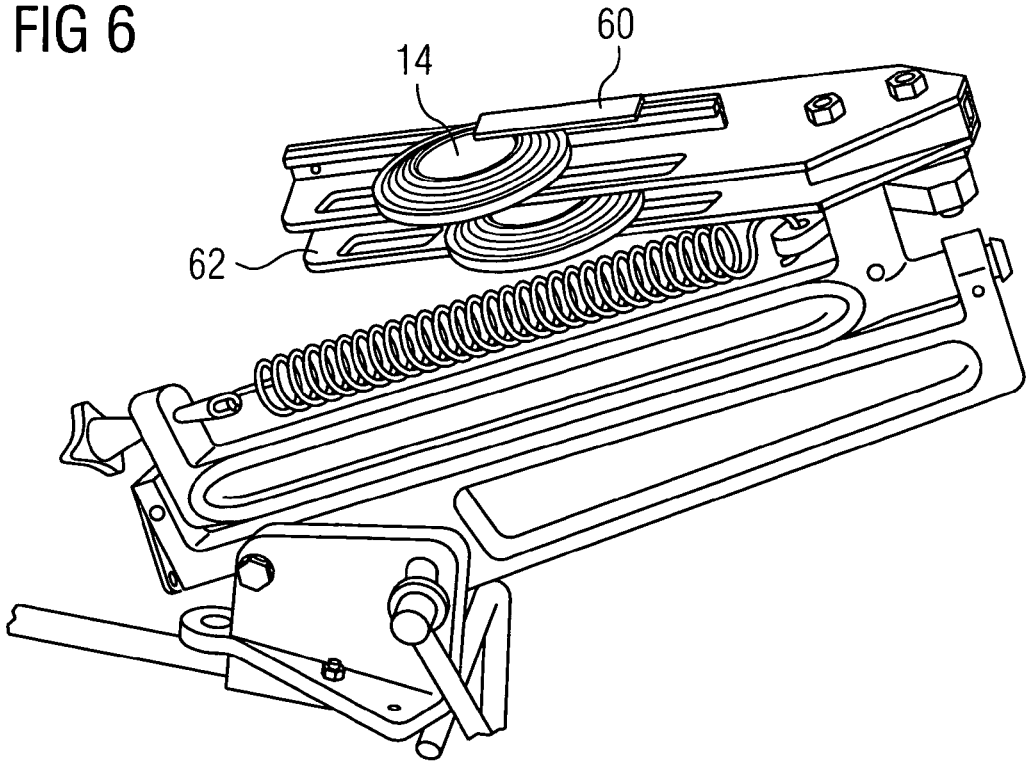
FIGS. 6-7 show launchers suitable for use in a method according to the present invention for launching sondes according to the present invention.

In certain preferred embodiments of the invention, the sonde may be shaped similarly to a clay pigeon or skeet. The sondes may be launched by a device 16 resembling a clay pigeon launcher. Sondes of an appropriate size and weight may in fact be launched by a clay pigeon launcher. FIG. 6 illustrates a basic, portable, manually loaded clay pigeon launcher suitable for deploying sondes according to the present invention. A sonde 14 is placed in a channel 60 of a spring-loaded throwing arm 62. When the spring is released, the arm 62 rotates very rapidly through approximately 180°. The inertia of the sonde and the frictional action of the wall of the channel 60 on the edge 41 or outer ring 45 of the sonde imparts a rapid spinning to the sonde. The rotation of the arm throws the sonde in an upwards and forwards direction, as shown in FIG. 1.

Figure 7:
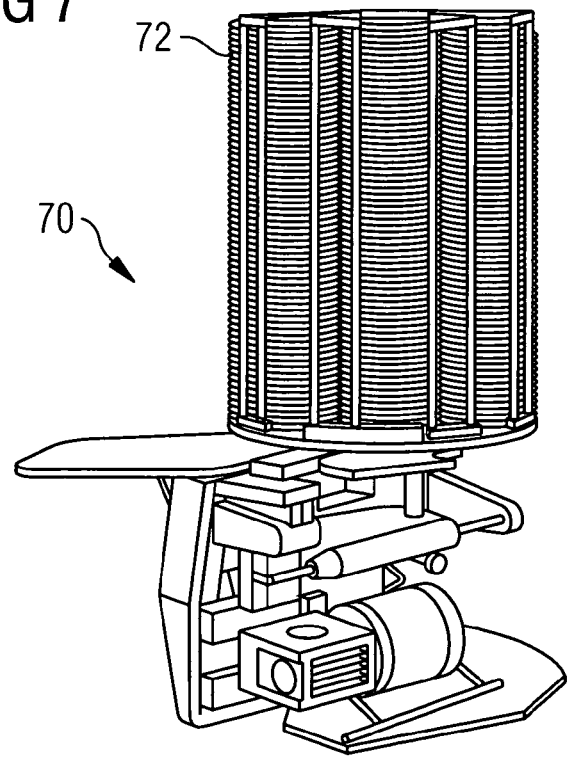

FIG. 7 shows a more complex launcher, also suitable for deploying sondes according to the present invention. A magazine 72 holds a large number of sonde, and the launcher automatically launches a sonde, reacts ready for the next launch, and reloads with another sonde from the magazine, in response to an electrical command signal. In an embodiment of the invention, a magazine-loaded launcher such as illustrated in FIG. 7 incorporates an induction coil for transferring magnetic energy to an induction coil in each sonde. The energy thus transferred is used to maintain the batteries in the sonde in a charged state. The launcher may also be equipped to test the communications capability of each sonde before it is launched. If a defective sonde is located, the launcher may decide not to deploy that sonde, but to alert an operator and/or to select a replacement sonde from the magazine(s).

The invention claimed is:

1. A method for deploying a reconnaissance sonde for providing information regarding a region of interest, said method comprising:

providing a reconnaissance sonde incorporating an energy source, at least one environmental sensor and an associated communication device in a robust, aerodynamically efficient casing;

deploying the sonde by imparting an axial spin and a radial directional velocity to the casing, sufficient to carry the sonde into the region of interest; and after the sonde has arrived in the region of interest, communicating with the communication device, whereby said sonde is enabled to transmit to a remote location sensor data from said at least one sensor, which sensor data characterize said region of interest.

2. The method according to claim 1, further comprising:

placing a launching device on a vehicle;

driving the vehicle through or alongside a region of interest;

launching at least one reconnaissance sonde into the region of interest;

withdrawing the vehicle from the region of interest; and establishing communication between the sonde and an operator located outside of the region of interest.

3. The method according to claim 1, where the step of deploying the sonde is performed by a mechanical launcher.

4. The method according to claim 1, where the step of deploying the sonde is performed by hand, by throwing the sonde in a manner which imparts to it both a radially oriented linear velocity and a rotational velocity about an axis that is oriented to provide gyro stabilization of the sonde in flight.

5.

6. A reconnaissance sonde for remote data collection, said sonde comprising:

an outer casing;

at least one environmental sensor, an energy source and communication device contained in said casing; wherein:

the outer casing is shaped as one of a discus, a saucer, a clay pigeon and a sheet, for deployment of said sonde by applying an axial spin and a radial directional velocity to the outer casing; and the communication device is configured to operate when the sonde has arrived at a desired location in a region of interest, and to transmit data that characterize said region of interest, from the at least one sensor, to a remote location.

7. The sonde according to claim 6, wherein said casing is made of resilient material.

8. The sonde according to claim 6, further comprising a resilient ring around its outer periphery, for partially absorbing the shock of landing.

9. Sonde according to claim 6, wherein:

the casing comprises upper and lower parts; and a cavity is formed between said upper and lower parts, for storage of the energy source, communication and control circuitry, and at least one sensor.

10. The sonde according to claim 6, wherein communications and control circuitry are provided on at least one circuit board, mounted inside the casing, between shock absorbing means.

11. The sonde according to claim 6, wherein the casing is formed in a single moulded part, including the energy source, communication and control circuitry, and the at least one sensor embedded therein.

12. The sonde according to claim 6, further comprising retractable antennas.

13. The sonde according to claim 6, wherein the at least one environmental sensor comprises at least one component selected from the group consisting of:

a video camera;

a gas detector;

a detector of biological species;

a microphone;

a seismometer;

a radiation detector;

a humidity detector;

an air pressure sensor; and a presence and/or motion detector.

14. A method for launching a remote data collection sonde having at least one environmental sensor, an energy source and a communication device with retractable antennas, all of which are contained in an outer casing that is shaped as one of a discus, a saucer, a clay pigeon and a skeet, said method comprising:

deploying the sonde by imparting an axial spin and a radial directional velocity to the casing, sufficient to carry the sonde into a region of interest;

after the sonde has arrived in the region of interest, communicating with the communication device, whereby said sonde is enabled to transmit to a remote location sensor data from said at least one sensor, which sensor data characterize said region of interest;

maintaining the antennas in a retracted position during storage, during launching and during flight; and moving the antennas to an operational position after deployment of the sonde in said region of interest.

15. The method according to claim 14, wherein:

the antennas are spring-loaded, and are initially latched into the retracted position; and impact of landing causes the latching to release, allowing the spring-loaded antennas to move under the action of the springs into their operational position.

* * * * *